US005266350A

United States Patent [19]

Grob et al.

[11] Patent Number: 5,266,350

[45] Date of Patent: Nov. 30, 1993

[54] PROCESSES AND MATERIALS FOR TREATMENT AND REPAIR OF ELECTROLYTIC CELL SEPARATORS

[75] Inventors: Neal A. Grob, Baton Rouge; John P. McGraw, Jr., Denham Springs, both of La.

[73] Assignee: The Dow Chemical Company, Midland, Mich.

[21] Appl. No.: 913,099

[22] Filed: Jul. 14, 1992

[51] Int. Cl.[5] ..... B32B 35/00

[52] U.S. Cl. ..... 427/140; 427/385.5; 427/393.5; 427/393.6; 156/94; 204/98; 204/296; 204/295

[58] Field of Search ..... 204/295, 296, 98; 106/287.1; 521/25, 28, 27; 427/140, 384, 393.6, 393.5, 385.5; 156/94; 252/62.30; 264/36

[56] References Cited

U.S. PATENT DOCUMENTS

| | | | |
|---|---|---|---|
| 3,979,276 | 9/1976 | Strain | 204/282 |
| 4,153,661 | 5/1979 | Ree et al. | 264/122 |
| 4,169,774 | 10/1979 | Kadija et al. | 204/98 |
| 4,173,526 | 11/1979 | Fang | 204/296 |
| 4,174,266 | 11/1979 | Jeffery | 204/128 |
| 4,210,515 | 7/1980 | Patil et al. | 204/266 |
| 4,453,991 | 6/1984 | Grot | 156/94 |
| 4,606,805 | 8/1986 | Bon | 24/296 |

*Primary Examiner*—Kathryn Gorgos

[57] ABSTRACT

Materials for treating and/or repairing electrolytic cell separators, especially diaphragms for chlor-alkali cells, including processes for making such treating materials and processes for using such materials to treat and/or repair an electrolytic cell separator or chlor-alkali diaphragm.

31 Claims, No Drawings

PROCESSES AND MATERIALS FOR TREATMENT AND REPAIR OF ELECTROLYTIC CELL SEPARATORS

The present invention relates to electrolyte-permeable separators for use in electrolytic cells, and more particularly, to processes and the materials used therein for treating or repairing incipient or existing holes in chlor-alkali cell diaphragms.

A variety of these diaphragms are currently known or used, including the predominant asbestos diaphragms, the polymer-modified asbestos diaphragms, and non-asbestos diaphragms. Each of these diaphragms when ruptured becomes ineffective and must be repaired or discarded. In addition, chlor-alkali cell diaphragms, and asbestos diaphragms in particular, often develop locally thin areas which, while not constituting holes or ruptures per se, nevertheless cause higher than desirable flow rates through the diaphragm and lower than desirable efficiencies. These locally thin areas will for purposes of the present disclosure and invention be considered as embraced within the term "incipient holes".

The art describes a number of processes and materials for extending the useful life of chlor-alkali diaphragms by repairing incipient or existing holes in such diaphragms. For example, U.S. Pat. No. 4,174,266 to Jeffery discloses the periodic or as-needed introduction of asbestos (in fiber or in powder form) into the anolyte of a chlor-alkali cell, so that the asbestos is deposited in holes in the diaphragm or over weakened areas. The holes and weakened areas are said to be thus reinforced with an additional layer of asbestos, and normal diaphragm porosity and integrity maintained. The additional asbestos can be added as a slurry or as moist solid sticks while the cell is in operation, and it is said that the technique is useful where the diaphragm contains "additives, impregnants, coatings, additional layers of asbestos on the surface thereof, or layers or impregnants of polymers such as thermoplastics, thermoset resins, halocarbon resins, fluorocarbon resins, ion exchange resins and the like."

U.S. Pat. No. 4,169,774 to Kadija et al. is directed to a method of treating porous asbestos diaphragms and porous polymer-modified asbestos diaphragms, wherein particles of a magnesium-containing silicate (e.g., talc) are fed into and dispersed in the brine in the anode compartment of a chlor-alkali cell. The particles contact and are deposited on the diaphragm to renew and reinforce the diaphragm. A dispersing agent may be used to prevent the particles from settling out of the brine before being deposited on the diaphragm.

U.S. Pat. No. 4,173,526 to Fang discloses treating a chlor-alkali cell diaphragm by passing a slurry containing a magnesium compound through the diaphragm.

U.S. Pat. No. 3,979,276 to Strain discloses a method for coating or sizing an asbestos diaphragm with a water-soluble silicate several times over the course of its life, either prior to or when actually showing signs of deterioration and incipient rupture. The method includes brushing, rolling, spraying or pulling a water-soluble silicate onto and through the anolyte surface of the diaphragm to provide thereon a coating of from about 0.01 grams of the silicate to about 5.0 grams per square foot.

U.S. Pat. No. 4,453,991 to Grot describes compositions and processes useful in repairing pinholes, abraded areas and similar defects in perfluorinated ion exchange membranes, such membranes having been used inter alia in membrane chlor-alkali cells. A patch of a perfluorinated membrane material (similar to that surface of the membrane to which the patch is applied) is glued to the defective area of the membrane via a liquid composition, with the liquid composition being prepared by contacting a perfluorinated ion exchange polymer with water and a lower alcohol at between 180 and 300 degrees Celsius in a closed vessel and then separating out any lower density liquid phase from the composition. The patch is pressed against the membrane at a temperature below the melting point of each perfluorinated polymer present in the membrane and patch, and the patch and membrane are heated to evaporate at least a part of the liquid medium of the composition.

The above-described processes and materials all leave something to be desired, however, in terms of their effectiveness in repairing incipient or existing holes in chlor-alkali diaphragms, in terms of their convenience and economy of use, and/or in terms of their safety to operators and plant personnel (e.g., requiring the handling of fibrous or powdered asbestos according to U.S. Pat. No. 4,174,266 to Jeffery.)

SUMMARY OF THE PRESENT INVENTION

The present invention offers safer, more effective and more convenient processes and materials for electrolytic cell separator treatment, repair, renewal and reinforcement, and especially chlor-alkali cell diaphragm treatment, repair, renewal and reinforcement.

In one aspect the present invention is directed to agglomerated treating materials for electrolytic cell separators, the treating material comprising in one embodiment agglomerated masses of a hydrophobic, chemically-resistant particulate or fibrous material or a hydrophobic, chemically-resistant mixture of particulate and fibrous materials, the polymeric solids from a polymeric solids dispersion, and a water-wettable material such as talc which by itself would not be suitable as a diaphragm treating material, but which when agglomerated with the hydrophobic, chemically-resistant material or materials creates a useful treating material. "Fibrous" and "fibers" as used above and elsewhere herein, it should be noted, are intended to embrace both fibers and fibrids/fibrills.

The present invention provides in another aspect processes for forming slurried treating materials useful for the direct treatment and/or repair of an electrolytic cell separator. In one grouping of related processes, the treating material is made by mixing some or all of the component materials thereof in water, then heating the water and the materials contained therein to a temperature sufficient to cause agglomeration of the materials but without driving off substantially all of the water in the overall mixture, and thereafter mixing in any remaining component materials. A variation of this process would involve mixing fully all of the component materials in water after the water has been heated to an appropriate temperature for causing an agglomeration of the component materials.

A second set of processes would involve reducing the pH of an initially basic slurry of the materials to be agglomerated. Where this pH reduction is accomplished in whole or in part by some form of acid neutralization, either or both of the additional steps of adding surfactant or polymeric solids dispersion beyond that contained initially in the slurry, and of heating the thus-modified slurry to agglomerate or further agglomerate the materials therein may be included. The pH reduction can simply involve in another embodiment removing a portion of the slurry liquid as by filtering and/or decanting, and adding water. Additional surfactant or polymeric solids dispersion can thereafter be added to the reduced-pH slurry, either with or without heating to agglomerate or further agglomerate the materials in the slurry. In still other variations on these embodiments, chemically-resistant fibrous materials of varying lengths, chemically-resistant particulate materials or mixtures of fibrous and particulate materials can be added to the initially basic slurry or to the reduced-pH slurry and then agglomerated with the component materials already in the slurry.

Processes of this second general type are especially suited for use with a diaphragm-forming slurry of the type described in commonly-assigned and copending application Ser. No. 07/852,041, and more particularly with any such slurry left over in a draw vat after drawing one or more diaphragms therein.

In a final aspect, the present invention provides processes for treating and/or repairing an electrolytic cell separator, e.g., an asbestos, a polymer-modified asbestos, or non-asbestos chlor-alkali diaphragm both on-line and off-line. A process for treating or repairing a diaphragm off-line comprises isolating a cell containing the diaphragm to be treated and removing the power thereto, adjusting the pH of the fluid on one side of the diaphragm so that it approaches the pH of the fluid on the opposite side of the diaphragm, and circulating a treating material through the diaphragm. The treating material can be any of the materials specifically described above or made by the processes described above, or can be an inorganic-polymer fiber composite of the type described in U.S. Pat. Nos. 4,853,101 and 5,091,252 to Hruska et al. and in European Patent EP 0 196 317 B1 (and especially can be a slurry of such an inorganic-polymer fiber composite).

A process for treating or repairing a diaphragm on-line simply comprises adding a treating material on the upstream side of the diaphragm in an operating cell. Again, the treating material can be any of the materials specifically described above or made by the processes described above, or can be an inorganic-polymer fiber composite (and especially can be a slurry of such an inorganic-polymer fiber composite).

The present treating materials and processes for treating and/or repairing electrolytic cell separators, and particularly chlor-alkali diaphragms, are generally effective for tightening a diaphragm, plugging holes in a diaphragm, minimizing inter-compartment gas exchange (e.g. hydrogen passage into an anolyte compartment of a chlor alkali cell), inhibiting cathode corrosion, and/or for coating a diaphragm's surface to decrease total brine flow through the diaphragm under normal cell operating conditions.

DETAILED DESCRIPTION OF PREFERRED EMBODIMENTS

By the present invention, materials which normally would not be suitable for use individually as chlor-alkali diaphragm treating materials or for such use as a mixture of discrete particles, fibers etc. are made into an effective single treating and/or repairing material by agglomerating the individually unsuitable materials.

Polyfluoroethylene particulates and fibers, for example, are desirably chemically-resistant and are for this reason employed in a number of the presently-known diaphragms, in addition to being employed in the diaphragms of commonly-assigned and copending application Ser. No. 07/852,041 (with such application being incorporated herein by reference).

"Polyfluoroethylene" for present purposes means any polymer of a halogenated ethylene wherein the halogen atoms consist of at least one fluorine atom and the balance, if any, of chlorine. Polytetrafluoroethylene fibers and particulates are exemplary of the polyfluoroethylene materials previously used in diaphragms.

It would be useful in the treatment and/or repair of asbestos, polymer-modified asbestos, and non-asbestos diaphragms to be able to simply add PFE (polyfluoroethylene) fibers and/or particulates to a cell including a diaphragm to be repaired and/or treated, have the PFE fibers and/or particulates flow to the area of an incipient or existing hole, and reinforce or cover the area with a chemically-resistant, diaphragm-suitable material.

Because PFE fibers are fundamentally hydrophobic, however, they tend to float in the aqueous fluids surrounding the diaphragms in chlor-alkali cells and do not flow properly to the area in need of reinforcement or repair.

Talc is water-wettable and thus does not float like the PFE materials. On the other hand, however, talc acts as a foam stabilizer so that the direct addition of free talc to a cell (whether alone or in combination with PFE materials) tends to result in undesirable foaming in the cell and a plugging up of cell outlets, e.g. a cell chlorine gas outlet.

By agglomerating in a preferred embodiment i) a hydrophobic, chemically-resistant fibrous material such as PTFE fibers or, more preferably, a hydrophobic, chemically-resistant mixture of PTFE particulate and fibrous materials with ii) polymeric solids from a polymeric solids dispersion and iii) a water-wettable material like talc, however, the agglomerated treating material is made sufficiently water-wettable to flow to the area of a diaphragm to be treated while still possessing chemical resistance, and while further not acting as a foam stabilizer in the diaphragm cell. The polymeric solids from the polymeric solids dispersion essentially act as a binder. The surfactant employed in the dispersion is thought to aid in causing the PTFE solids, the polymeric solids from dispersion, and the talc to come together and agglomerate in a slurry of the treating material, such a slurry being the preferred form in which the treating material is prepared, stored and delivered into a cell for treatment of the diaphragm contained therein.

A preferred polymeric solids dispersion will include the same chemically-resistant polyfluoroethylene (e.g., polytetrafluoroethylene) materials as used for the hydrophobic, chemically-resistant fibrous materials or mixed hydrophobic, chemically-resistant particulate and fibrous materials, but the solids in the dispersion will preferably be in the nature of sub-micron sized particulates as opposed to fibers or the larger particles mixed with the polymeric solids dispersion. In this regard, the polymeric solids from the dispersion act essentially as a binder, while the hydrophobic fibers form a networked fibrous array with the talc, and the larger hydrophobic particles (e.g., those having a diameter preferably of from about 9 to about 20 microns on average and greater) fill the interstices of the networked array. A suitable polymeric solids dispersion, for example, is sold as Teflon TM 30 PTFE dispersion by E. I. DuPont de Nemours & Co., Inc., and consists of micron-sized PTFE particulates in water, with a nonionic, oetylphenoxypolyethoxyethanol surfactant.

The amounts of the preferred nonionic surfactants and of the polymeric solids necessary to achieve a degree and strength of agglomeration (with talc or other given water-wettable material) for forming a suitable diaphragm-treating material will depend on the fluid environment in which a slurried treating material of the present invention is to be formed, and on the temperature at which all of the various component materials are finally present in the fluid environment.

One process for forming a preferred treating material involves i) mixing talc and PTFE particulates and fibers in water, ii) heating this mixture to a temperature sufficient (with the addition of a polymeric solids dispersion of micron-sized PTFE particulate solids in water with a nonionic surfactant) to cause an agglomeration of the talc, PTFE particulates and fibers, and PTFE particulate solids from the dispersion but without driving off the water, and then iii) adding to the heated mixture the polymeric solids dispersion. Typically, this process will involve heating the slurry to a temperature of at least about 35 degrees Celsius, although preferably the slurry will be heated to from about 50 degrees Celsius up to about 99 degrees Celsius. Alternately, the water can be heated to the requisite temperature prior to the addition of the talc and/or PTFE particulates and fibers. In still another process, the talc, PTFE particulates and fibers, and the polymeric solids dispersion can be added to the water for forming the slurried treating material, and then the entire mixture heated. Regardless of when the heating occurs, however, it will in each case be preferable to add the polymeric solids dispersion after the talc and PTFE fibers and particulate solids.

In these processes and with these materials, the talc will generally be employed in proportion to a surfactant (which preferably is a nonionic surfactant, such as the commercially-available Triton TM X-100 octylphenoxypolyethoxyethanol surfactant from Rohm & Haas) from the polymeric solids dispersion. Suitable ratios of talc to the oetylphenoxypolyethoxyethanol surfactant are about 50 parts talc to about 3 parts by weight of such surfactant, although preferably the ratio will be about 100:1, and more preferably will be about 500:3. At higher ratios, less heat and lower temperatures will normally be required to achieve an equivalent degree of agglomeration. Other surfactants may implicate other ratios for achieving a suitable degree of agglomeration with the talc and PTFE fibrous and particulate materials.

It is considered that in addition to a composition including a water-wettable material, a polymeric solids dispersion and a hydrophobic fibrous material or mixture of hydrophobic fibrous and particulate materials as has been previously described, still other treating material compositions could be employed in water according to the basic processes described above. For example, one such composition comprises a first, water-wettable material, a surfactant, and a second suitably chemically-resistant material. A second such composition would combine a polymeric solids dispersion of chemically-resistant polymeric solids with a water-wettable material.

The second group of processes for forming the present treating materials (i.e., those processes involving reducing the pH of an initially basic slurry of the materials to be agglomerated) preferably utilizes an existing slurry of the component materials (such as for example residual slurry from the drawing of one or more diaphragms in a draw vat), and in particular embodiments is directed to the use of an existing slurry in which the component materials are not agglomerated or are not sufficiently agglomerated to serve as a treating material in a particular application.

In one embodiment, the pH is reduced of an initially basic slurry including a first, water-wettable material such as talc which by itself would not be a suitable treating material, a surfactant and a second, suitably chemically-resistant material (e.g., PTFE) which also would not be suitable alone as a treating material. Where this pH reduction is accomplished in whole or in part by acid neutralization, the heat of neutralization and the amount of surfactant originally in the slurry may be sufficient to cause an agglomeration of the water-wettable and chemically-resistant materials (where these were not agglomerated initially), or to cause an enhanced degree of agglomeration suitable to the hole to be repaired or prevented (where the water-wettable material and chemically-resistant material were agglomerated initially in the slurry). If the heat of neutralization and initial surfactant level are insufficient to achieve this desired degree of agglomeration, then additional surfactant may be added and/or additional heating may be employed to get agglomerated masses suited to the hole to be repaired or prevented.

Where the pH reduction is done simply by removing a portion of the initial slurry liquid, e.g., by filtering, decanting or a combination of filtering and decanting, and then adding water, additional surfactant will generally need to be added and/or the modified slurry will be heated to a sufficient temperature with the ending level of surfactant to achieve the requisite degree of agglomeration.

In either of these processes, it is expected that it will also be possible to add longer or shorter chemically-resistant fibers, larger or smaller chemically-resistant particulates, or various mixtures and combinations of such particulates and fibers to the residual slurry and thereafter adjust the level of surfactant and temperature to incorporate and agglomerate these newly-added materials with those already in the slurry. Those skilled in the art will recognize that this sort of "fine-tuning" of the slurried treating material for a given hole or incipient hole will also be possible with the slurried treating materials prepared according to processes of the first general type as more particularly described above.

In a second embodiment of a process involving an existing slurry, the initial slurry is comprised of a polymeric solids dispersion of chemically-resistant polymeric solids and the water-wettable material, and the processes for forming a treating material from this initial slurry are like those described in the preceding several paragraphs, except that where additional surfactant is needed this surfactant is supplied through additional polymeric solids dispersion.

In a third embodiment, the slurry initially comprises a hydrophobic, chemically-resistant particulate or fibrous material or a mixture of particulate and fibrous materials, a polymeric solids dispersion, and a water-wettable material. It will generally be preferred in this embodiment that the hydrophobic, chemically-resistant material or materials be present as a mixture of fibers and large particulate solids for plugging existing holes (via the fibers), and for filling in the gaps or interstices of the fibrous network formed over an existing hole by the fibers. The processes for forming a treating material from such slurry are generally as in the first and second embodiments of the second overall group of processes, and as in the second embodiment where additional surfactant is required this is preferably supplied in the form of additional polymeric solids dispersion.

In each of these various embodiments from the second set of processes, the pH of the initial slurry will preferably be reduced at least to a substantially neutral pH, since the slurried treating material will in a preferred on-line treating process be added to the anolyte/acid brine side of a chlor-alkali cell, and since lower pH's in the slurry will generally require less surfactant or polymeric solids dispersion to be present or added at a given temperature to cause a degree of agglomeration appropriate to the treating application (i.e., the hole or area to be treated).

The temperature to which the slurry is heated will also have some effect on the amount of surfactant or polymeric solids dispersion required to be present or to be added, and in general higher temperatures will require less surfactant or polymeric solids dispersion. A temperature in the range of from about 60 degrees Celsius up to about 99 degrees Celsius is preferred.

A particularly preferred process of the second general type for forming a slurried treating material of the present invention employs, as suggested above, a residual slurry from a draw vat in which one or more diaphragms have been drawn. The initially basic slurry preferably includes a hydrophobic, chemically-resistant particulate or fibrous material or more preferably a mixture of particulate and fibrous materials, a polymeric solids dispersion and a water-wettable material. More preferably, the slurry includes surfactant from the polymeric solids dispersion and agglomerated masses of the hydrophobic and water-wettable materials and of the polymeric solids from the polymeric solids dispersion.

A slurry of this more preferred variety is described, for example, in copending and commonly-assigned U.S. Ser. No. 07/852,041, wherein PTFE fibers, a dispersion of polyfluoroethylene (and especially PTFE) particulate solids, and talc are combined in a slurry in an aqueous caustic solution, with the talc, PTFE fibers and polyfluoroethylene particulate solids being agglomerated together for drawing a diaphragm therefrom.

The talc is preferably employed in proportion to the surfactant from the dispersion. Where a preferred nonionic, octylphenoxypolyethoxyethanol surfactant is employed from a dispersion of polyfluoroethylene solids in water (e.g, Teflon TM 30 PTFE solids dispersion, E.I. DuPont de Nemours & Co., Inc.), the ratio of talc to such surfactant by weight in the final slurry material is preferably at least about 50 parts talc to three (3) parts surfactant, more preferably is at least about 50:], and most preferably is at least about 200:3. The slurry for these ratios will generally need to be at, or be heated to, a temperature of at least about 60 degrees Celsius up to about 99 degrees Celsius. Higher temperatures and slurry pH's will generally require less of the polyfluoroethylene solids to be added to achieve the desired degree of agglomeration.

As for whether it will be preferable to make a slurried treating material of the present invention from an existing slurry as opposed to making a treating material according to the water-based processes described above, this may largely be dependent on the availability of tanks, filter presses and other apparatus for treating/modifying an existing slurry. Where it is feasible to do so, it is expected that making up the slurried treating materials of the present invention from residual diaphragm-forming slurry will normally be preferred.

In the context of achieving an appropriate agglomeration of the various component materials and combinations thereof mentioned herein, it is considered that by matching a particular surfactant to a particular water-wettable material and a particular hydrophobic and particulate polymeric solid and by mixing these at a high enough temperature, an agglomeration could be formed simply from the hydrophobic and particulate polymeric solid and the water-wettable material.

In most applications, it will be desirable to also utilize in the treating material a suitably chemical-resistant fibrous material, but given an appropriate match between the surfactant and polymeric solids of the polymeric solids dispersion and the water-wettable material, the fibrous material can be any of a variety of materials including polyfluoroethylene fibers (especially PTFE fibers), ceramic fibers, asbestos fibers, carbon fibers, and Kevlar TM aromatic polyamide fibers, for example. The PTFE fibers are preferred, and depending on the size of the hole to be plugged in a diaphragm these PTFE fibers can range from 1/64th of an inch to 4½ inches in length, and be from about 3.2 to about 6.7 deniers per filament on average. The hydrophobic particulate solids employed will preferably be of a size or range of sizes appropriate to fill in interstices in a network of these fibers, or in the absence of such fibers to fill in any holes or support any weakened areas of the diaphragm when agglomerated together in the slurry of treating material.

The use as a treating material of an inorganic-polymer fiber composite of the type described in U.S. Pat. Nos. 4,853,101 and 5,091,252 to Hruska et al. and European Patent EP 0 196 317 B1 (and especially a slurry of such an inorganic-polymer fiber composite) is also contemplated by the present invention. Methods of making such inorganic-polymer fiber composites, of making slurries from such fiber composites, and of making diaphragms from such fiber composites are described in the referenced United States, and these patents are accordingly incorporated herein by reference.

With respect to the use of these inorganic-polymer fiber composites as treating materials according to the present invention, a corresponding, on-line treating process comprises the steps of: i) making an inorganic-polymer fiber by a process including a) combining inorganic, refractory particulates and organic precursor particles for said polymer fiber, b) bringing the combination of inorganic particulates and organic precursor particles to an elevated temperature sufficient for the organic precursor particles to soften and flow under pressure but insufficient for substantial decomposition of the organic precursor particles, and c) vigorously grinding or shearing the combination at such elevated temperature for a time sufficient to allow the softened organic precursor particles to flow under grinding or shearing pressure and to fibrillate in the presence of the inorganic particulates, whereby the inorganic particulates are bound with the polymer fiber at least at a surface thereof; and ii) adding the inorganic-polymer fiber upstream of the separator while the cell is in operation. The fiber composite may be added directly to the cell in a dry form, or may be added in a slurry form (e.g, in water).

A generalized process for treating and/or repairing a chlor-alkali diaphragm or other electrolytic cell separator on-line thus simply comprises adding a treating material of the present invention to the cell upstream of the diaphragm or separator, while the cell is in operation. The higher flow through the weakened area or through a hole in the diaphragm results in the treating material being drawn to the weakened area or hole, and the treating material reinforces or plugs the area or hole, respectively. It is presently considered that asbestos, polymer-modified asbestos, and non-asbestos diaphragms may all be suitably treated and/or repaired by the processes and treating materials of the present invention.

A process for treating a diaphragm or cell separator off-line comprises the steps of stopping any flow of process materials in and out of the cell, removing the power to the cell, adjusting the pH of the fluid on one side of the separator toward the pH of the fluid on the opposite side of the separator, adding any of the treating materials described above to the cell, and circulating the treating material through the separator via the cell fluid. In most circumstances, it will be preferable, however, to treat the separator on-line in an operating cell.

The present invention is further illustrated by the examples which follow:

Example 1

An amount of about 50 grams of talc (commercially available Mistron Vapor Talc from Cyprus Industrial Minerals Company, about 1.5 microns average diameter) and about 5 grams of Teflon TM polytetrafluoroethylene (PTFE) fibers (commercially available from E. I. DuPont de Nemours & Co., Inc., about 1/64 inches long (6.2 denier per filament (DPF)) were mixed together in a bottle with about 300 mL of water at 70° C. After shaking of the mixture in the bottle, about 8 grams of Teflon TM 30 PTFE solids dispersion were added (E. I. DuPont de Nemours & Co., Inc., about 60% by weight of PTFE particles of about 0.27 microns average size dispersed in an aqueous solution of about 6% by weight of Triton TM X-100 octylphenoxypolyethoxyethanol, nonionic surfactant based on solids). The ratio by weight of talc to the surfactant in dispersion was thus about 520:3, or roughly 173:1.

Solids of agglomerated talc and fibers formed and then settled in the bottle, with no free talc being apparent in the slurry which might contribute to or stabilize foaming in a cell. The mixture was mixed at 1500 r.p.m. in a Lightin' TM mixer to break up the large masses. An amount of about 41 grams of the resulting slurry were added via a syringe to an operating chlor-alkali test cell having a non-asbestos type cell diaphragm made according to copending U.S. application Ser. No. 07/852,041. The diaphragm was rectangular, about 6 in. long and about 5in. wide. The cell prior to addition of the slurried treating material exhibited high flow due to a crack in a DeraKane TM polyvinyl ester resin (The Dow Chemical Company) seal around the diaphragm, and between the diaphragm and a mount made from chlorinated polyvinyl chloride.

Prior to addition of the treating material, flow rate through the cell was about 5400 mL per hour. About 30 minutes after addition of the treating material, flow rate through the cell decreased to 225 mL per hour. The test cell flow stayed at decreased levels for about 2 hours. The flow then increased again (partially due to a washing away of the treating material adjacent the seal material).

Example 2

A second slurry was made for treating a cell. Thirty (30) grams of the same talc as in Example 1 were combined with 10 grams of the same Teflon TM polytetrafluoroethylene (PTFE) fibers in a bottle with about 300 mL of water at 70° C. After shaking of the mixture in the bottle, an amount of about 50 grams of the Teflon TM 30 PTFE solids dispersion were added. The resulting ratio by weight of talc to surfactant was thus about 50:3.

No agglomeration was observed of the materials. On addition of 39 grams of the slurry into the operating cell, some of the slurry solids settled in the anolyte, while most of the solids were carried into the top of the header, forming a plug which had to be cleaned out later. A significant amount of foaming was observed. No change was seen in the flow through the diaphragm one day after the slurry was added.

Example 3

An intermediate slurry was formed as in Examples 1 and 2 using 80 grams of the talc of Examples 1 and 2 above, 10.5 grams of 1/64" long natural brown PTFE fibers (6.2 denier per filament) and 600 mL of water at 50 degrees Celsius. To this intermediate slurry, there was added 15 grams of the Teflon TM 30 PTFE solids dispersion. A thickly agglomerated slurry was formed which appeared to have good potential for use as a diaphragm treating and/or repairing material.

A chlor-alkali test cell having a 6" by 5" non-asbestos diaphragm therein which had been soaking for two days in alkaline brine was then prepared for operation, while first making three holes in the diaphragm with a paper clip. On starting up the cell at a 10" head of alkaline brine, flow through the perforated diaphragm was at 15,100 mL per hour.

Fifty (50) mL of the slurried treating material were then added to the cell via a syringe, and one to two minutes after this addition the flow had decreased slightly to 14,400 mL per hour.

Several fifty mL shots of anolyte were withdrawn from the cell and injected via an anolyte sample valve to increase circulation. Eight minutes after adding the initial 50 mL slurry sample, flow through the diaphragm had decreased to 12,720 mL per hour.

At this point, another 90 mL of the slurry was added to the cell through the chlorine header pipe, followed by about 100 mL of alkaline brine to wash off any slurry deposited on the walls of the header pipe. The head was lowered to allow a portion of the agglomerated treating material which was floating in the cell to get to the holes made previously in the diaphragm. A steady flow of materials was observed through the diaphragm, with portions of the agglomerated treating material being observed coming through the holes in the diaphragm. Flow through the diaphragm at a head of 10" eventually leveled out at about 13,200 mL per hour, for an approximately 13% reduction in the original flow through the diaphragm prior to the addition of the about 140 mL of slurried treating material to the cell.

Example 4

An intermediate slurry was prepared which comprised 80 grams of the talc used in previous examples, 10 grams of ⅛" long (6.7 denier per filament) natural brown PTFE fiber, and 600 mL of water at 50 degrees Celsius. To this there was added 15 grams of the Teflon TM 30

PTFE solids dispersion. The mixture was hand shaken, and the solids therein appeared to be well agglomerated.

Fifty (50) mL of this slurried treating material were added to the already partly-treated cell of Example 3 via a syringe, although some of the fibers in the slurry were observed to plug the syringe.

After 5 minutes, the flow through the diaphragm at a 10" head dropped from 13,200 mL per hour to 3200 mL per hour. After an additional five minutes had elapsed, the flow had dropped to 1680 mL per hour. Seven minutes later, the flow was 1350 mL per hour. After another fifteen minutes, the flow had fallen to 990 mL per hour. Twenty minutes later still saw the flow at 1,080 mL per hour.

Another 60 mL of the second slurried treating material of this Example were then added through the top of the header, followed by alkaline brine as a wash. After 13 minutes the flow through the diaphragm was still at 1,110 mL per hour, which nevertheless represented a 93% reduction in flow from the 15,100 mL per hour figure seen prior to addition of any of the slurried treating materials of this Example and the previous Example 3.

To determine whether the patches would hold in the absence of flow through the diaphragm, flow through the cell was stopped and the diaphragm was soaked overnight with a heater in place. Flow was resumed the following day at a 14" head, at 3000 mL per hour. Another 60 mL of the slurried treating material from Example 3 was then added via a syringe, with the slurried treating material being added at room temperature after having been stored throughout the testing of this Example in a laboratory hood. Flow through the diaphragm at a 14" head dropped to 210 mL per hour only some 2 to 3 minutes after the addition of the slurried treating material.

While various embodiments have been described and exemplified herein of the diaphragm-treating materials of the present invention, of processes for forming such materials, and of processes for using such materials in the treatment and/or repair of electrolytic cell separators and chlor-alkali diaphragms more particularly, those skilled in the art will recognize that a number of changes may be made in these embodiments which do not truly depart in scope and spirit from that which is claimed specifically hereafter.

What is claimed is:

1. A process for forming a slurried material for the direct treatment of electrolytic cell separators, comprising the steps of:

reducing the pH of an initially basic slurry including talc which by itself is not suited as a separator treating material, a surfactant and a hydrophobic, chemically-resistant polymeric material which also is not suited by itself as a separator treating material;

adding additional surfactant to the slurry; and heating the slurry and the additional surfactant added thereto to a temperature of from about 35 degrees Celsius to 99 degrees Celsius which causes agglomeration of the talc and the polymeric material where the ratio by weight of talc to surfactant from said slurry is at least about 50:3.

2. A process as defined in claim 1, wherein the talc and the polymeric material in the slurry initially are agglomerated together, and further wherein the addition of said additional surfactant with heating results in enhanced agglomeration of the talc and the polymeric material.

3. A process for forming a slurried material for the direct treatment of electrolytic cell separators, comprising the steps of:

reducing the pH of an initially basic slurry which includes:

i) a polymeric solids dispersion of chemically-resistant polymeric solids; and ii) talc which by itself would not be suited as a separator treating material, but which when agglomerated with the chemically-resistant polymeric solids from said dispersion creates a useful treating material for electrolytic cell separators;

adding additional polymeric solids dispersion to the slurry; and heating the slurry and the additional polymeric solids added thereto to a temperature of about 35 degrees Celsius to about 99 degrees Celsius to cause agglomeration of the chemically-resistant polymeric solids and the talc wherein the ratio by weight of talc to surfactant from the dispersion is at least about 50:3.

4. A process as defined in claim 3, wherein the chemically-resistant polymeric solids and the talc in the slurry initially are agglomerated together, and further wherein the addition of the additional surfactant with heating results in enhanced agglomeration of the chemically-resistant polymeric solids and the talc.

5. A process for forming a slurried treating material for the direct treatment of electrolytic cell separators, comprising the steps of:

reducing the pH of an initially basic slurry which includes;

i) a hydrophobic, chemically-resistant particulate or fibrous polymeric material or a hydrophobic, chemically-resistant mixture of particulate and fibrous polymeric material;

ii) a polymeric solids dispersion; and iii) talc which by itself would not be suited as a separator treating material, but when agglomerated with the hydrophobic chemically-resistant polymeric material creates a useful treating material for electrolytic cell separators;

adding additional polymeric solids dispersion to the slurry; and heating the slurry, and the additional polymeric solids dispersion added thereto to a temperature of about 35 degrees Celsius to about 99 degrees Celsius to cause agglomeration of the hydrophobic polymeric materials, the polymeric solids, and the talc wherein the ratio by weight of talc to surfactant in the dispersion is at least about 50:3.

6. A process as defined in claim 5, wherein the hydrophobic polymeric material, the polymeric solids from said dispersion and the talc in the slurry initially are agglomerated together, and further wherein the additional surfactant with heating results in enhanced agglomeration of the hydrophobic polymeric material, the polymeric solids and the talc.

7. A process as defined in either of claim 5 or 6, wherein the treating material is formed using residual slurry from a draw vat in which one or more separators have been drawn and which slurry comprises surfactant from the polymeric solids dispersion and agglomerated masses of the hydrophobic polymeric material and the talc and of the polymeric solids from said polymeric solids dispersion, by:

one or more cycles of settling out solids in said slurry:
decanting a portion of liquid in said slurry; and
reducing the pH of the slurry remaining after decanting said liquid portion;
adding additional polymeric solids dispersion to the slurry produced by one or more of said settling cycles; and
heating the slurry and the additional polymeric solids dispersion added thereto to a temperature of about 35 degrees Celsius to about 99 degrees Celsius to cause enhanced agglomeration of the hydrophobic material, the polymeric solids, and the talc.

8. A process as defined in claim 5 wherein the polymeric solids dispersion is a dispersion of a surfactant and sub-micron sized polyfluoroethylene particulate solids in water.

9. A process as defined in claim 8, wherein the ratio of talc to surfactant from the dispersion is at least about 200:3.

10. A process according to claim 5, wherein the slurry and the additional polymeric solids dispersion added thereto are heated to a temperature of at least about 60 degrees Celsius to about 99 degrees Celsius.

11. A process as defined in claim 5, wherein the hydrophobic, chemically-resistant polymeric materials include polyfluoroethylene fibers.

12. A process as defined in claim 11, wherein the hydrophobic, chemically-resistant polymeric materials further include polyfluoroethylene particulates having an average particle diameter in the range of from about 9 to about 20 microns.

13. A process for forming a slurried material for direct treatment of electrolytic cell separators, comprising the steps of:
reducing the pH of an initially basic slurry including talc which by itself is not suited as a separator treating material, a surfactant and a hydrophobic chemically-resistant polymeric material which is also not suited by itself as a separator treating material;
and adding additional surfactant to the slurry,
wherein the slurry prior to adding the additional surfactant is at a temperature of from about 35 degrees Celsius to about 99 degrees Celsius such that adding the additional surfactant causes agglomeration of the talc and the polymeric material where the ratio of talc to surfactant from said slurry is at least about 50:3.

14. A process as defined in claim 13, wherein the talc and the polymeric material are initially agglomerated together in the slurry, and further wherein adding the additional surfactant results in enhanced agglomeration of the talc and the polymeric material.

15. A process for forming a slurried material for direct treatment of electrolytic cell separators, comprising the steps of:
reducing the pH of an initially basic slurry including
i) a polymeric solids dispersion of chemically-resistant polymeric solids; and
ii) talc which by itself would not be suited as a separator treating material, but which when agglomerated with the chemically-resistant polymeric solids from said dispersion creates a useful separator treating material for electrolytic cell separators; and
adding additional polymeric solids dispersion to the slurry,
wherein the slurry prior to the addition of said additional polymeric solids dispersion is at a temperature of about 35 degrees Celsius to about 99 degrees Celsius such that the added polymeric solids dispersion causes agglomeration of the chemically-resistant polymeric solids and the talc where the ratio by weight of talc to surfactant from said dispersion is at least about 50:3.

16. A process as defined in claim 15, wherein the chemically-resistant polymeric solids and the talc are initially agglomerated in the slurry, and further wherein the added polymeric solids dispersion results in enhanced agglomeration of the chemically-resistant polymeric solids and the talc.

17. A process for forming a slurried material for direct treatment of electrolytic cell separators, comprising the steps of:
reducing the pH of an initially basic slurry including
i) a hydrophobic, chemically-resistant particulate or fibrous polymeric material or a hydrophobic, chemically-resistant mixture of particulate and fibrous polymeric material;
ii) a polymeric solids dispersion; and
iii) talc which by itself would not be suited as a separator treating material, but which when agglomerated with the hydrophobic, chemically-resistant material creates a useful separator treating material; and
adding additional polymeric solids dispersion to the slurry,
wherein the slurry prior to adding the additional polymeric solids dispersion is at a temperature of from about 35 degrees Celsius to about 99 degrees Celsius such that the added dispersion causes agglomeration of the hydrophobic polymeric material, the polymeric solids in said dispersion, and the talc where the ratio by weight of talc to surfactant from said dispersion is at least about 50:3.

18. A process as defined in claim 17 wherein the hydrophobic polymeric material, the polymeric solids from said dispersion and the talc in the slurry initially are agglomerated together, and further wherein the added surfactant results in enhanced agglomeration of the hydrophobic polymeric material, the polymeric solids from said dispersion and the talc.

19. A process as defined in either of claims 17 or 18, wherein the separator treating material is formed using residual slurry from a draw vat in which one or more separators have been drawn, and which slurry comprises surfactant from the polymeric solids dispersion and agglomerated masses of the polymeric hydrophobic material and the talc and of the polymeric solids from said polymeric solids dispersion, by:
one or more cycles of settling out solids in said slurry;
decanting a portion of liquid in said slurry; and
reducing the pH of the slurry portion remaining after decanting said liquid portion; and
adding additional polymeric solids dispersion to the slurry produced by one or more of said settling cycles.

20. A process as defined in either of claims 17 or 18, wherein the slurry is at a temperature of from at least about 60 degrees Celsius to about 99 degrees Celsius when the additional polymeric solids dispersion is added thereto.

21. A process as defined in claim 17, wherein the polymeric solids dispersion is a dispersion of a surfactant and submicron sized polyfluoroethylene particulate solids in water.

22. A process as defined in claim 21, wherein the ratio of talc to surfactant from the dispersion is at least about 200.3.

23. A process as defined in claim 17, wherein the hydrophobic, chemically-resistant materials include polyfluoroethylene fibers.

24. A process as defined in claim 23, wherein the hydrophobic, chemically-resistant materials further include polyfluoroethylene particulates having an average particle diameter in the range of from about 9 to about 20 microns.

25. A process for treating a separator for an electrolytic cell off line, comprising the steps of:

stopping any flow of process materials in and out of the cell;

removing power to the cell;

adjusting the pH of fluid on one side of the separator in the direction of the pH of the fluid on an opposite side of the separator;

adding an agglomerated separator treating material where the agglomerated material comprises:

i) a hydrophobic, chemically-resistant fibrous polymeric material or a hydrophobic, chemically-resistant mixture of particulate and fibrous material;

ii) polymeric solids from a polymeric solids dispersion; and iii) talc which by itself is not suited as a separator treating material, but which when agglomerated with the hydrophobic, chemically-resistant polymeric material creates a useful separator treating material; and circulating the agglomerated treating material through the separator.

26. A process for treating a separator for an electrolytic cell off-line, comprising the steps of:

stopping any flow of process materials into and out of the cell;

removing power to the cell;

adjusting the pH of fluid on one side of the separator in the direction of the pH of fluid on an opposite side of the separator;

adding an agglomerated separator treating material where the agglomerated material comprises:

i) talc which by itself is not suited as a separator treating material; and ii) a hydrophobic, chemically-resistant polymeric material which by itself is also not suited as a separator treating material; and circulating the agglomerated treating material through the separator 27. A process for treating a separator for an electrolytic cell off-line, comprising the steps of:

stopping any flow of process materials into and out of the cell;

removing power from the cell;

adjusting the pH of fluid on one side of the separator in the direction of the pH of fluid on an opposite side of the separator;

adding an agglomerated separator treating material where the agglomerated treating material comprises:

i) talc which is not suited by itself as a separator treating material; and ii) hydrophobic, chemically-resistant polymeric solids circulating the agglomerated treating material through the separator.

28. A process as defined in any one of claims 25, 26 or 27, wherein the separator is a diaphragm in a chlor-alkali cell.

29. A process as defined in claim 28, wherein the diaphragm is a polymer-modified asbestos diaphragm.

30. A process as defined in claim 28, wherein the diaphragm is an asbestos diaphragm.

31. A process as defined in claim 28, wherein the diaphragm is a non-asbestos diaphragm.

* * * * *

UNITED STATES PATENT AND TRADEMARK OFFICE

CERTIFICATE OF CORRECTION

PATENT NO. : 5,266,350

DATED : November 30, 1993

INVENTOR(S) : Neal A. Grob and John P. McGraw, Jr.

It is certified that error appears in the above-identified patent and that said Letters Patent is hereby corrected as shown below:

Column 16, Claim 27, lines 28-29, insert -- from a polymeric solids dispersion, and -- between "solids" and "circulating".

Signed and Sealed this

Fourteenth Day of March, 1995

*Attest:*

Bruce Lehman

BRUCE LEHMAN

*Attesting Officer*

*Commissioner of Patents and Trademarks*